US008567940B2

(12) United States Patent
Tajima

(10) Patent No.: US 8,567,940 B2
(45) Date of Patent: Oct. 29, 2013

(54) MEDIUM FEED DEVICE AND RECORDING APPARATUS

(75) Inventor: Hiroyuki Tajima, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 92 days.

(21) Appl. No.: 13/015,048

(22) Filed: Jan. 27, 2011

(65) Prior Publication Data

US 2011/0187803 A1 Aug. 4, 2011

(30) Foreign Application Priority Data

Jan. 29, 2010 (JP) ..... 2010-019150

(51) Int. Cl.
*B41J 2/01* (2006.01)

(52) U.S. Cl.
USPC ..... 347/104; 347/101

(58) Field of Classification Search
USPC ..... 358/296; 271/10.11, 275, 225, 3.19; 347/37, 16, 101, 104; 400/605, 607, 400/607.1, 691–693; 399/388, 392
See application file for complete search history.

(56) References Cited

U.S. PATENT DOCUMENTS 4,748,516 A * 5/1988 Harano et al. ..... 358/296
4,966,358 A * 10/1990 Yokoi et al. ..... 271/10.11
5,488,396 A * 1/1996 Burke et al. ..... 347/37
6,193,426 B1 * 2/2001 Guillemin ..... 400/605
7,058,352 B2 * 6/2006 Ozawa et al. ..... 399/392
2004/0047662 A1 * 3/2004 Ozawa et al. ..... 399/388
2004/0076457 A1 * 4/2004 Chung ..... 399/361
2005/0225594 A1 10/2005 Isono et al.
2009/0121423 A1 * 5/2009 Nakamura et al. ..... 271/275
2010/0237557 A1 * 9/2010 Hara et al. ..... 271/225
2011/0221817 A1 * 9/2011 Yamashita et al. ..... 347/16
2012/0223471 A1 * 9/2012 Matsumoto ..... 271/3.19

FOREIGN PATENT DOCUMENTS

CN 101244655 8/2008
JP 2002-362804 12/2002
JP 2002-362805 12/2002

* cited by examiner

*Primary Examiner* — Manish S Shah
*Assistant Examiner* — Yaovi Ameh
(74) *Attorney, Agent, or Firm* — Workman Nydegger

(57) ABSTRACT

A medium feed device has a configuration in which a feed section is provided to send a medium in the front-and-back direction of the medium feed device, the device includes a guide member which guides the medium in the back face side of the medium feed device, the guide member is provided to be capable of being extended and contracted in a direction connecting the base end side and the free-end side of the guide member, and the guide member forms a feed pathway for the medium which is held to have a roll shape which is sent further from the back face side than the guide member, in a first state where the guide member is contracted, and forms a feed pathway for a fed medium of a single sheet shape which is sent from the guide member, in a second state where the guide member is extended.

8 Claims, 10 Drawing Sheets

MEDIUM FEED DEVICE AND RECORDING APPARATUS

The entire disclosure of Japanese Patent Application No.2010-019150, filed Jan. 29, 2010 is expressly incorporated by reference herein.

BACKGROUND

1. Technical Field

The present invention relates to a medium feed device including a feed pathway, on which a fed medium is sent, and a feed section which sends the fed medium, and having a configuration capable of sending a fed medium of a single sheet shape and a fed medium having a roll shape, and a recording apparatus provided with the medium feed device.

In this application, as the recording apparatus, apparatuses such as an ink jet printer, a wire dot printer, a laser printer, a line printer, a copying machine, a facsimile, and the like shall be included.

2. Related Art

In the past, as shown in JP-A-2002-362804 and JP-A-2002-362805, a printer that is one example of a recording apparatus has been provided with a medium feed device and a recording section. Then, the medium feed device has been provided with a feed pathway, a feed section, and a motor. Also, a rolled paper holder has been provided so as to be able to be attached to and detached from a main body of the medium feed device. Therefore, in a case where it was desired to carry out recording on a rolled paper, recording on the rolled paper could be carried out by attaching the rolled paper holder, in which the rolled paper is set, to the medium feed device.

Incidentally, in the case of carrying out recording on a medium such as a cardboard, consideration is given to detaching the rolled paper holder and then replacing it with a medium support member which guides the medium in a direction inclined with respect to a feed pathway.

Shown in FIGS. 10A and 10B are side views showing an outline of a medium feed device which is considered by the invention. Of these, FIG. 10A shows a state where the rolled paper holder is detached and the medium support member is attached. On the other hand, FIG. 10B shows a state where the medium support member is detached and the rolled paper holder is attached.

As shown in FIGS. 10A and 10B, a medium feed device 50 includes a feed roller 52, a hopper 51, a feed pathway 55, a first engaged portion 53, and a second engaged portion 54. Of these, the feed roller 52 is provided so as to be able to send paper set in the hopper 51 to the downstream side in a feed direction. Also, the hopper 51 is provided so as to be able to move toward or away from the feed roller 52. Further, the feed pathway 55 is configured so as to be able to guide the paper to a recording section (not shown) provided at the downstream side in the feed direction. Also, the first engaged portion 53 and the second engaged portion 54 are provided at the back face side of the medium feed device 50. On the other hand, a first engagement portion 57 and a second engagement portion 58 are provided at a medium support member 56. Then, in the case of attaching the medium support member 56 to a main body of the medium feed device, attachment can be performed by making the first engagement portion 57 and the first engaged portion 53 be engaged with each other and making the second engagement portion 58 and the second engaged portion 54 be engaged with each other. Also, detachment can be performed by releasing the engagement.

Also, a press-in portion 60 and a third engagement portion 61 are provided at a rolled paper holder 59. The press-in portion 60 is held so as to be able to rotate with respect to the rolled paper holder 59. Also, the rolled paper holder 59 is constituted so as to be able to hold a rolled paper by pressing the press-in portion 60 into a core of the rolled paper. Also, a configuration is also acceptable in which the rolled paper holder 59 simply supports the inside of the core of the rolled paper. Then, in the case of attaching the rolled paper holder 59 to the main body of the medium feed device, attachment can be performed by making the third engagement portion 61 and the second engaged portion 54 be engaged with each other. Also, detachment can be performed by releasing the engagement.

Then, in a case where the medium support member 56 is attached, after a medium such as cardboard is set at the downstream side in the feed direction at the time of recording, the medium is first sent to the upstream side in the feed direction. Then, the medium such as the cardboard is sent to the upstream side in the feed direction until the downstream end of the medium arrives further at the upstream side in the feed direction than the recording section. Thereafter, consideration is given to making a configuration such that recording is carried out while sending the medium to the downstream side in the feed direction. In such a case, by attaching the medium support member 56, it is possible to reduce the amount, by which the medium such as the cardboard on the back face side of the medium feed device 50 protrudes from the medium feed device 50 to the back face side, compared to a configuration having no medium support member 56.

However, in the case of changing the kind of the sent medium from a medium such as cardboard to a rolled paper, it is necessary to detach the medium support member 56 and then attach the rolled paper holder 59. Therefore, this is inconvenient for a user. Also, there is a possibility that the detached medium support member 56 may be lost.

Similarly, in the case of changing the kind of the sent medium from the rolled paper to the medium such as the cardboard, it is necessary to detach the rolled paper holder 59 and then attach the medium support member 56. Therefore, this is inconvenient for a user. Also, there is a possibility that the detached rolled paper holder 59 may be lost.

SUMMARY

An advantage of some aspects of the invention is that it provides a medium feed device, in which with respect to a sent medium, the convenience when selecting a fed medium of a single sheet shape and a fed medium having a roll shape is considered, and a recording apparatus provided with the medium feed device.

According to a first aspect of the invention, there is provided a medium feed device including: a feed pathway, on which a fed medium is sent, and a feed section which sends the fed medium and having a configuration capable of sending a fed medium of a single sheet shape and a fed medium having a roll shape, wherein the feed section is provided so as to send the fed medium in the front-and-back direction of the medium feed device, the medium feed device is provided with a guide member which guides the fed medium in the back face side of the medium feed device, the guide member is provided so as to be able to be extended and contracted in a direction connecting the base end side and the free-end side of the guide member, and the guide member forms a feed pathway for the fed medium having a roll shape which is sent further from the back face side than the guide member, in a first state where the guide member is contracted, and forms a feed pathway for the fed medium of a single sheet shape which is sent from the guide member, in a second state where the guide member is extended.

According to the first aspect of the invention, in the case of sending the fed medium having a roll shape, it is not necessary to detach the guide member. That is, when changing over the sent medium from the fed medium of a single sheet shape to the fed medium having a roll shape, only changing-over from the second state to the first state is required without detaching the guide member. As a result, the convenience for a user can be improved.

Also, since it is not necessary to detach the guide member, there is no danger that the guide member will be lost.

Also, a roll holding section that is a section which holds the fed medium having a roll shape may be integrated with the medium feed device or may be a separate body.

According to a second aspect of the invention, in the first aspect, the medium feed device may further include a roll holding section which holds the fed medium having a roll shape, and also in the second state of the guide member, the roll holding section can hold the fed medium having a roll shape.

According to the second aspect of the invention, in addition to the same working effects as those of the first aspect, it is possible to change the guide member from the first state to the second state in a state where the fed medium having a roll shape remains set to the roll holding section. That is, it is not necessary to detach the fed medium having a roll shape. As a result, it is possible to respond to both the feed of the fed medium having a roll shape and the feed of the fed medium of a single sheet shape without requiring detachment or exchange of the roll holding section and the guide member.

According to a third aspect of the invention, in the first or the second aspect, in the first state of the guide member, the free end of the guide member may come into pressure-contact with a place of the fed medium unwound from the roll shape, regardless of the magnitude of the outer diameter of the fed medium having a roll shape held by the roll holding section.

According to the third aspect of the invention, in addition to the same working effects as those of the first or the second aspect, when the fed medium having a roll shape has been unwound, the position of the fed medium in the feed pathway can be stabilized regardless of whether the remaining amount of the fed medium before being unwound is large or small. That is, it is possible to maintain a constant position of the unwound fed medium regardless of whether the remaining amount of the fed medium having a roll shape is large or small. As a result, the occurrence of so-called jamming, in which the fed medium is jammed in the feed pathway, can be prevented. That is, the fed medium can be stably sent.

According to a fourth aspect of the invention, in the third aspect, the free end of the guide member may come into pressure-contact with a face of the fed medium unwound from the roll shape, which was the outside in a step before being unwound.

According to the fourth aspect of the invention, in addition to the same working effects as those of the third aspect, when the fed medium having a roll shape has been unwound, a curling tendency of an unwound portion in the fed medium can be reduced.

Specifically, by bending back the fed medium to a position which is the reverse of a position when the fed medium has been wound into a roll shape, it is possible to reduce a curling tendency. By reducing the curling tendency, for example, it is possible to reduce frictional resistance between the feed pathway and the fed medium. Also, it is possible to stabilize the position of the fed medium in the feed pathway. As a result, the occurrence of so-called jamming, in which the fed medium is jammed in the feed pathway, can be prevented. That is, the fed medium can be stably sent.

According to a fifth aspect of the invention, in any one of the first to the fourth aspects, the guide member may take, in the back face side of the medium feed device, a first position which follows the back face, and a second position which is a position fallen further to the rear than the back face, thereby being inclined with respect to the front-and-back direction, and enter a state where the guide member can be extended and contracted.

According to the fifth aspect of the invention, in addition to the same working effects as those of any one of the first to the fourth aspects, it is possible to make the guide member be in the first position and then house the guide member, in a case where the guide member is not used.

Also, the second position is a position in which the guide member is obliquely fallen backward. Here, if it is a configuration in which the guide member is fallen until it follows the front-and-back direction, the guide member comes into contact with an obstacle such as a wall on the back face side of the medium feed device, so that there is a danger that the second position cannot be completely taken. Then, in this aspect, the second position is a position in which the guide member is obliquely fallen backward. Therefore, even in a case where a sufficient space cannot be secured in the back face side, the second position can be taken. That is, the guide member can be opened backward.

According to a sixth aspect of the invention, in the fifth aspect, the guide member being in the second state and having the second position may guide the leading end side in an advancing direction of the fed medium of a single sheet shape sent from the front side in the front-and-back direction in the feed pathway to the back side by the feed section, onto the guide member, and the fed medium of a single sheet guided onto the guide member may be sent from the guide member to the front side in the front-and-back direction by the feed section.

According to the sixth aspect of the invention, in addition to the same working effects as those of the fifth aspect, a configuration is provided in which the fed medium of a single sheet shape is first sent to the back side and then sent to the front side. It is a so-called switchback feed method. Here, the second position is a position in which the guide member is obliquely fallen backward, as described above. Even in a case where the fed medium has been sent to the back side, the possibility that it may come into contact with an obstacle such as a wall on the back face side can be reduced.

As a result, there is no possibility that it will be necessary to perform a task in which a user changes an installation location of the medium feed device in order to secure a space around the back of the medium feed device.

According to a seventh aspect of the invention, there is provided a recording apparatus including: a medium feed section which sends a recorded medium in a feed direction; and a recording section which performs recording on the recorded medium sent by the medium feed section, by a recording head, wherein the medium feed section includes the medium feed device according to any one of the first to the sixth aspects, and the recorded medium is the fed medium.

According to the seventh aspect of the invention, the medium feed section includes the medium feed device according to any one of the first to the sixth aspects, and the recorded medium is the fed medium. Therefore, in the recording apparatus, the same working effects as those of any one of the first to the sixth aspects can be obtained.

Also, in the case of performing recording in the third or the fourth aspect, a face, with which the free end of the guide member comes into pressure-contact, may be set to be a back face opposite to a surface that is a recorded face. As a result, there is no danger that the guide member will damage the surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

First, an explanation will be made regarding an outline of an ink jet printer (hereinafter referred to as a "printer") as one example of a "recording apparatus" or a "liquid ejecting apparatus" which is provided with a medium feed device according to the invention and a main section of the invention will be then described.

Here, the liquid ejecting apparatus is not limited to the recording apparatuses such as an ink jet type recording apparatus, a copying machine, and a facsimile, which eject ink from a recording head as a liquid ejecting head onto a recorded material such as a recording paper, thereby carrying out recording onto the recorded material, and is used in a meaning that includes an apparatus which ejects liquid equivalent to a specific use, in place of ink, from a liquid ejecting head equivalent to the above-described recording head onto an ejected material equivalent to the recorded material, thereby adhering the liquid to the ejected material.

Also, as the liquid ejecting head, besides the above-described recording head, the following heads can be exemplified; a color material ejecting head which is used for the manufacturing of a color filter of a liquid crystal display or the like, an electrode material (electrical conductive paste) ejecting head which is used for the formation of electrodes of an organic EL display, a surface-emitting display (FED), or the like, a biological organic matter ejecting head which is used for the manufacturing of a biochip, a sample ejecting head which ejects a sample as a precision pipette, and the like.

Figure 1:
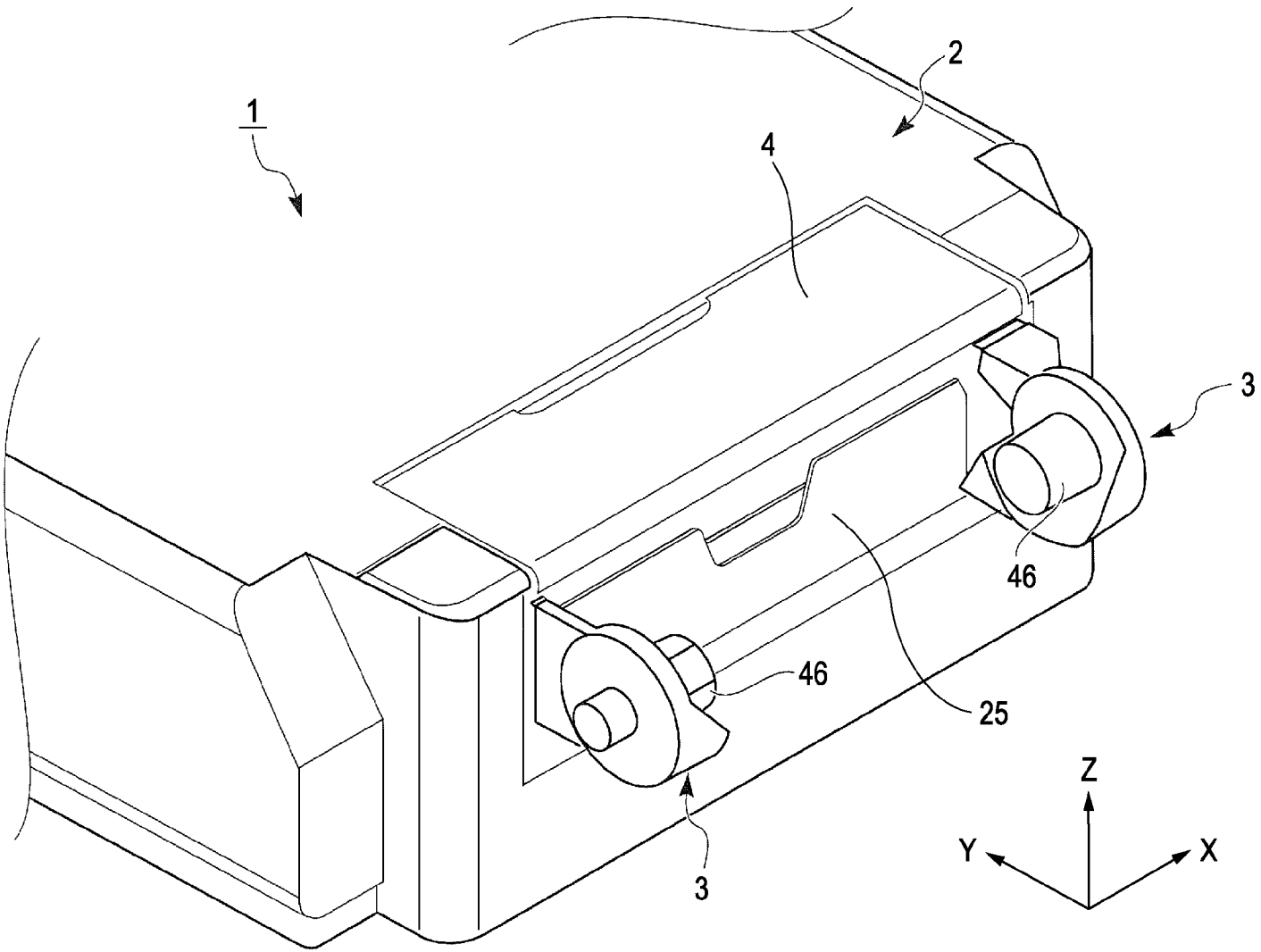
FIG. 1 is a rear perspective view showing a state where a movable guide member of a printer according to the invention is closed.
Figure 2:
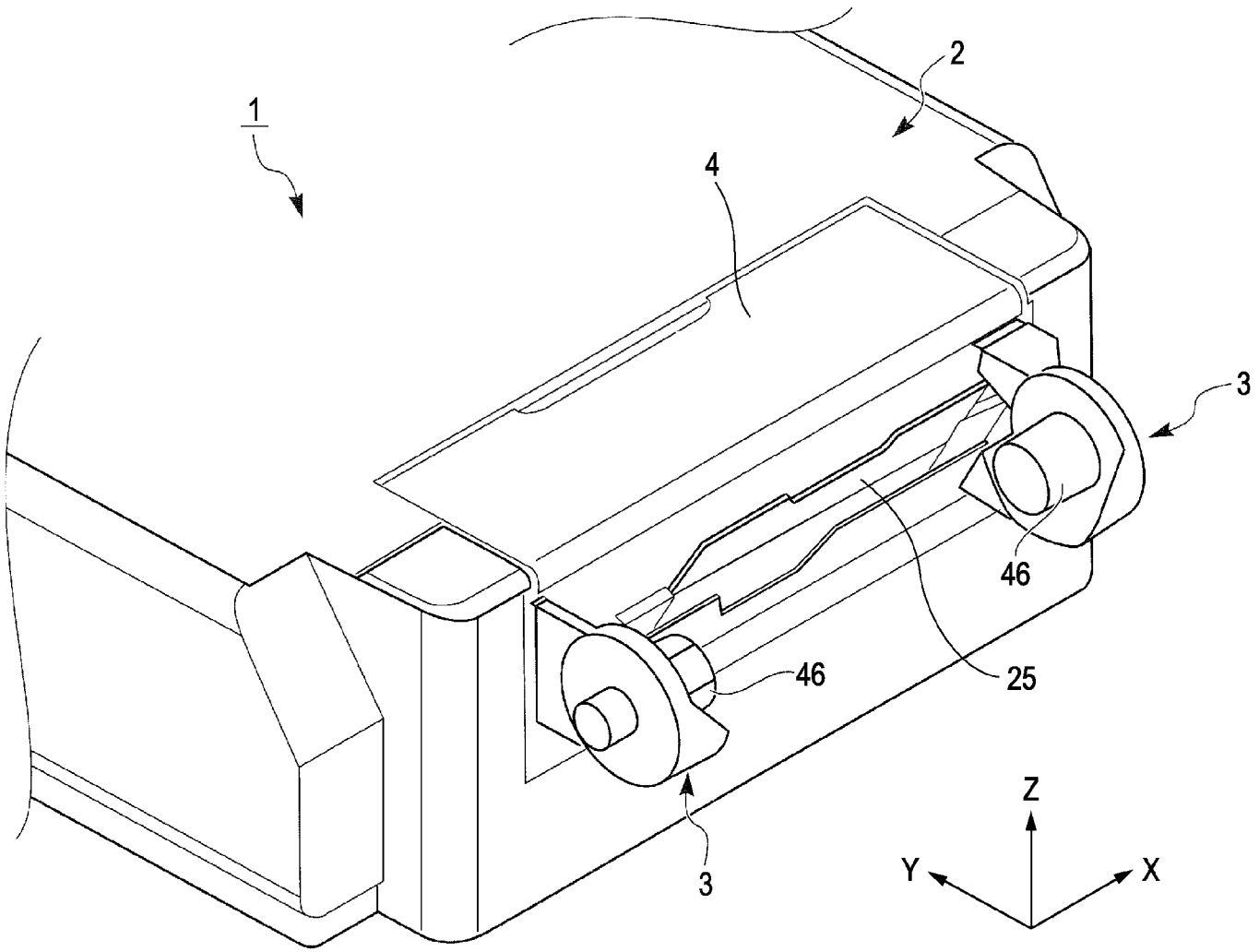
FIG. 2 is a rear perspective view showing a state where the movable guide member according to the invention is opened and extended.

Shown in FIG. 1 is a rear perspective view with the enlarged main section showing a state where a movable guide member of the printer according to the invention is closed. Also, shown in FIG. 2 is a rear perspective view with the enlarged main section showing a state where the movable guide member of the printer according to the invention is opened and extended. Further, shown in FIG. 3 is a rear perspective view with the enlarged main section showing a state where the movable guide member of the printer according to the invention is opened and contracted.

Figure 3:
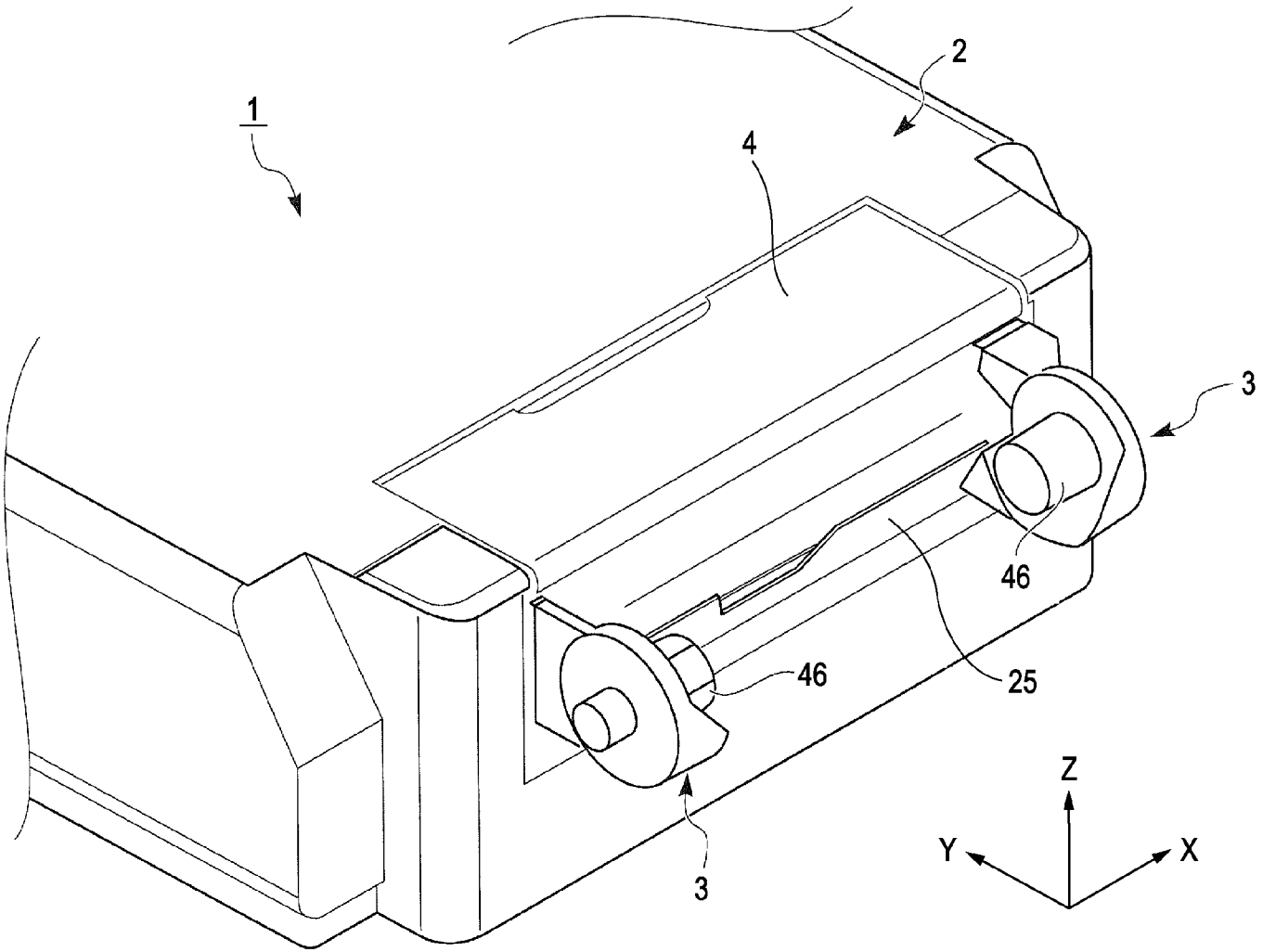
FIG. 3 is a rear perspective view showing a state where the movable guide member according to the invention is opened and contracted.

As shown in FIGS. 1 to 3, a printer 1 has a housing 2. Also, a medium feed device 42 (refer to FIGS. 4 to 7), which will be described later, is provided in the inside of the housing 2. Then, a first cover member 4 (refer to FIGS. 1 to 7) is provided on the upper side in a vertical direction in the printer 1. The first cover member 4 (refer to FIGS. 1 to 7) shown in FIGS. 1 to 3 is in a closed state. However, the first cover member 4 is provided such that the first cover member is opened upward, whereby a user can set a plain paper P1 that is one example of a first type of medium in a hopper 23 as a first placement section (refer to FIGS. 4 to 7), which will be described later.

Here, the "first type of medium" means a medium which can be sent on a first feed pathway (R1 (refer to FIG. 4)) by a feed roller 27 that is a first feed section 26 (refer to FIGS. 4 to 7), as will be described later. Specifically, it means a medium which has flexibility and an elasticity value lower than a first given elasticity value and is sent by the first feed section 26 (refer to FIGS. 4 to 7) which provides a smaller feed force than a second feed section 35 (refer to FIGS. 4 to 7), which will be described later, to a medium, and a medium which is sent one by one from a state where the media are stacked on the first placement section 22 (refer to FIGS. 4 to 7). Also, the "plain paper" means normally-used paper having a weight approximately in the range of 60 g/square meter to 90 g/square meter. Of course, the plain paper may be paper having a weight outside this range.

The "first given elasticity value" is a limit value which allows the medium (P1) to be sent on the first feed pathway (R1) by the first feed section 26 (refer to FIGS. 4 to 7). That is, it is the highest value among elasticity values which allows the sending.

Also, an operation section (not shown) having buttons and the like is provided at the front of the printer 1. A configuration is made such that recording conditions, the conditions of the medium such as paper, and the like can be set by an operation of the operation section (not shown) by a user. Further, a configuration is made such that a signal for the start of execution of recording is sent to a control section (not shown) by an operation of the operation section.

Furthermore, a second cover member 5 (refer to FIGS. 4 and 7) is provided at the front of the printer 1. Then, the second cover member 5 (refer to FIGS. 4 and 7) is provided so as to be able to be opened and closed.

Although the details will be described later, it is possible to make the second cover member 5 be in a state where it is opened forward (refer to FIGS. 4 and 7). By opening the second cover member 5 and then sliding and extending the second cover member so as to draw out the inside of the second cover member 5, the second cover member 5 plays the role of a first tray 7 (refer to FIGS. 4 and 7) as a first discharge section 6 (refer to FIGS. 4 and 7), to which the plain paper P1 is discharged.

Also, if the second cover member 5 (refer to FIGS. 4 and 7) is opened, a second tray 10 (refer to FIGS. 5 and 6) of the inside can protrude to the front of the printer 1. Although the details will be described later, in a state where the second tray 10 has protruded, the second tray 10 (refer to FIGS. 5 and 6) plays the role of a second placement section 8 (refer to FIGS. 5 and 6), on which a paperboard or a CD-R tray P2 that is one example of a second type of medium having a thickness, and an exclusive paper P3 that is one example of a third type of medium can be placed.

Here, the "second type of medium" means a medium which cannot be sent on the first feed pathway (R1) by the first feed section 26, as will be described later. Specifically, it means a medium having no flexibility and having high rigidity or a medium having strong elastic force equal to or greater than a second given elasticity value even if it has flexibility. Also, the "paperboard" means a medium in which a panel (board) is integrated with a medium.

The "second given elasticity value" is a value higher than the first given elasticity value and is a limit value which does not allow the medium (P2) to be sent on a third feed pathway (R3) by the second feed section 35 (refer to FIGS. 4 to 7). That is, it is the lowest value among elasticity values which do not allow the sending.

Also, the "third type of medium" means a medium which cannot be sent on the first feed pathway (R1) by the first feed section 26, like the "second type of medium", and means a medium having flexibility and an elastic force which is weak compared to the "second type of medium". More specifically, it means a medium having an elasticity value which is equal to or more than the first given value elasticity and is less than the second given value elasticity. Also, the "exclusive paper" is paper used for a specific purpose such as a photograph, unlike the plain paper P1, and means paper which is strong in so-called stiffness, compared to the plain paper P1. This "stiffness" means an elastic force.

Figure 5:
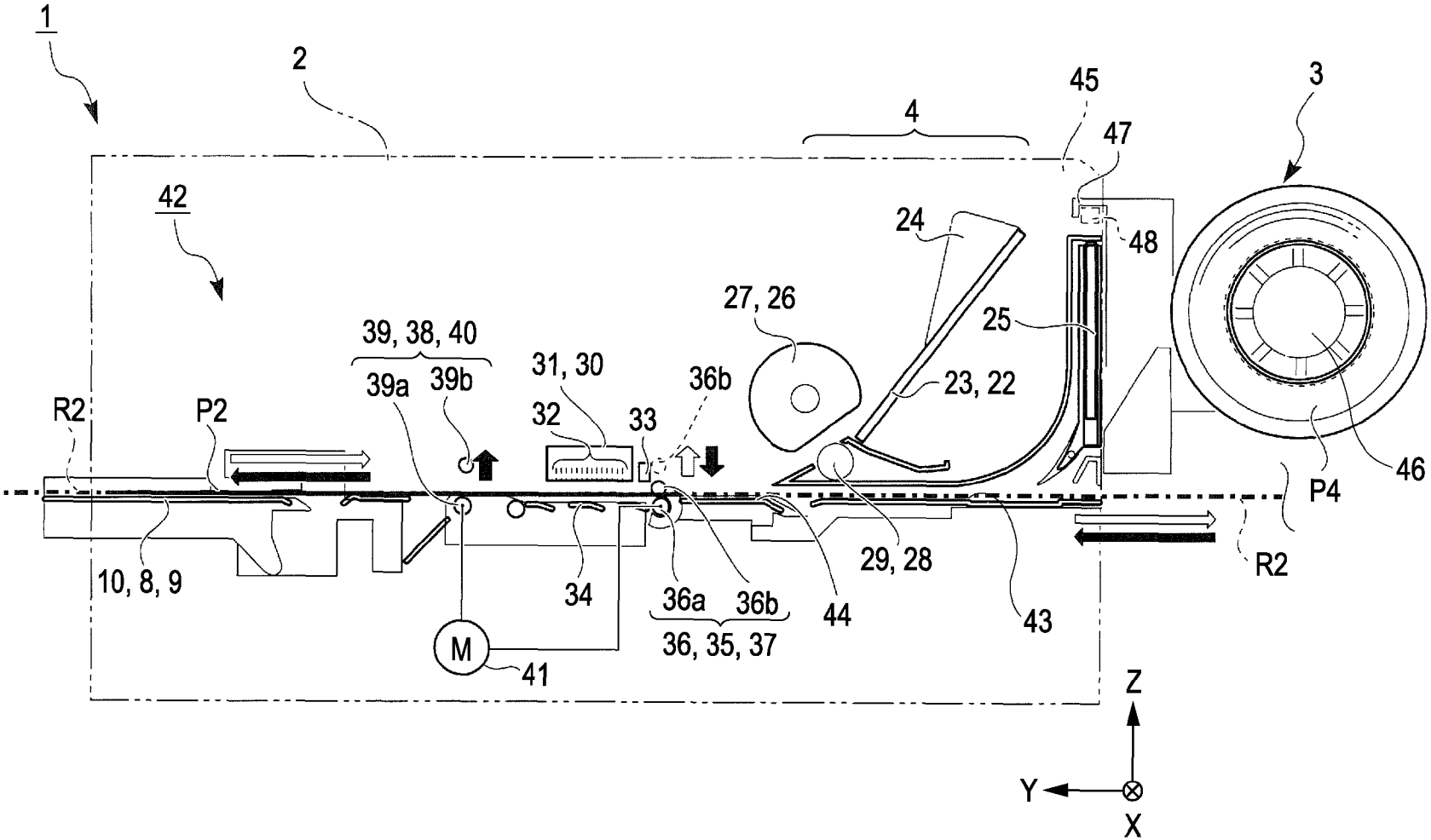
FIG. 5 is a schematic side view showing the inside of the printer according to the invention (at the time of transporting a second type of medium).
Figure 6:
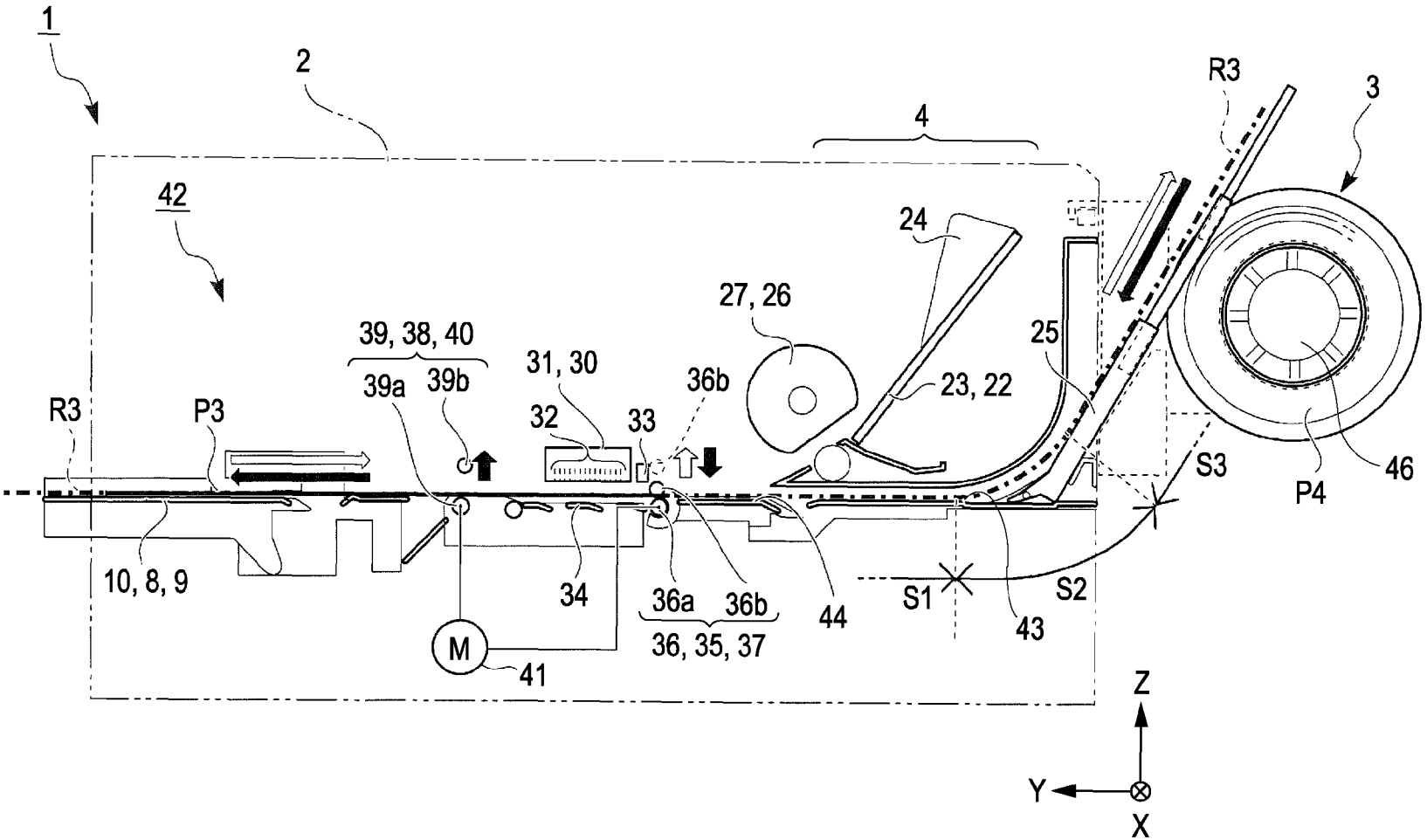
FIG. 6 is a schematic side view showing the inside of the printer according to the invention (at the time of transporting a third type of medium).

Also, second edge guides (not shown) which determine the positions of the set "second type of medium" and the set "third type of medium" in a width direction X are provided at the second tray 10 (refer to FIGS. 5 and 6).

Further, the second tray 10 (refer to FIGS. 5 and 6) also plays the role of a second discharge section 9 (refer to FIGS. 5 and 6), to which the paperboard or the CD-R tray P2 and the exclusive paper P3 are discharged after completion of recording.

Furthermore, a movable guide member 25 is provided at the back of the printer 1. FIGS. 2 and 3 show a state where the movable guide member 25 is opened backward. Of these, FIG. 2 shows a state where the movable guide member 25 is opened and then slid so as to draw out the inside of the movable guide member 25, thereby being extended upward. As will be described later in detail, the movable guide member 25 is provided so as to make the medium feed pathway (R3) have a curved configuration in a side view by making the movable guide member be in an opened state when recording on the exclusive paper P3 (refer to FIG. 6).

Also, as will be described later for the details, a roll holder 3 which holds a rolled paper P4 that is one example of a fourth type of medium having a roll shape is provided at the back of the printer 1.

Here, the "fourth type of medium" is a medium in a state where it is wound into a roll shape at a step before being sent, and means a medium which can be unwound and sent. The stiffness is set to be weak to the extent that a roll shape can be made.

Also, in FIGS. 1 to 3, illustration of the rolled paper P4 is omitted. This is to facilitate the understanding of a state of the movable guide member.

Subsequently, a main section of the invention will be described in detail.

As shown in FIGS. 1 to 3, the movable guide member 25 is provided so as to be able to be opened and closed to the rear of the printer 1. Then, as shown in FIG. 1, in a state where the movable guide member 25 is closed, a configuration is made such that the movable guide member is flush with the same face as the back face of the housing 2. In other words, in a case where the movable guide member 25 is not used, the movable guide member 25 is housed such that the outer face thereof is flush with the same face as the back face of the housing 2.

On the other hand, as shown in FIG. 2, in a state where the movable guide member 25 is opened, as described above, it is possible to make the movable guide member be in a state (an extended state) where it is slid so as to draw out the inside of the movable guide member 25, thereby being extended upward. Then, as will be described later, it is possible to make the feed pathway (R3) a configuration having a curved section S2 in a side view (refer to FIG. 6).

Further, as shown in FIG. 3, in a state where the movable guide member 25 is opened, it is possible to make the movable guide member be in a state where the inside of the movable guide member 25 is housed and the movable guide member is contracted with respect to the extended state shown in FIG. 2. Then, as will be described later, it is possible to send the rolled paper P4 set in the roll holder 3 on a feed pathway (R4 (refer to FIG. 7)).

Also, the roll holder 3 is provided so as to be able to be attached to and detached from a base body portion 45 of a printer main body. This is for pressing a press-in portion 46 of the roll holder 3 into a core of the rolled paper P4, thereby mounting the rolled paper, when setting the rolled paper P4. Also, this is for pulling out the press-in portion 46 of the roll holder 3 from the core of the used rolled paper, thereby replacing the used rolled paper with a new rolled paper P4.

Specifically, the roll holder is engaged by hooking a hook-like engagement portion 47 provided at the roll holder 3 on an engaged portion 48 provided at the back face side of the printer main body.

Accordingly, a configuration is made such that the roll holder 3 can be attached to the printer main body (refer to FIGS. 4 to 7). Then, a configuration is made such that the roll holder 3 can be detached from the printer main body by releasing the engagement of the engagement portion 47 and the engaged portion 48.

Also, with regard to an opening and closing operation of the movable guide member 25, although a user may manually perform the opening and closing operation, it is a matter of course that a configuration may be made such that the opening and closing operation is automatically performed by the power of a motor. In the case of the configuration of automatically performing the opening and closing operation, the configuration can be made such that the printer 1 performs the opening and closing operation by making a decision based on the set recording conditions, the set conditions of the medium such as paper, or the like.

The Case of the Plain Paper: The First Type of Medium P1

Subsequently, an explanation will be made regarding the inside of the printer 1.

Figure 4:
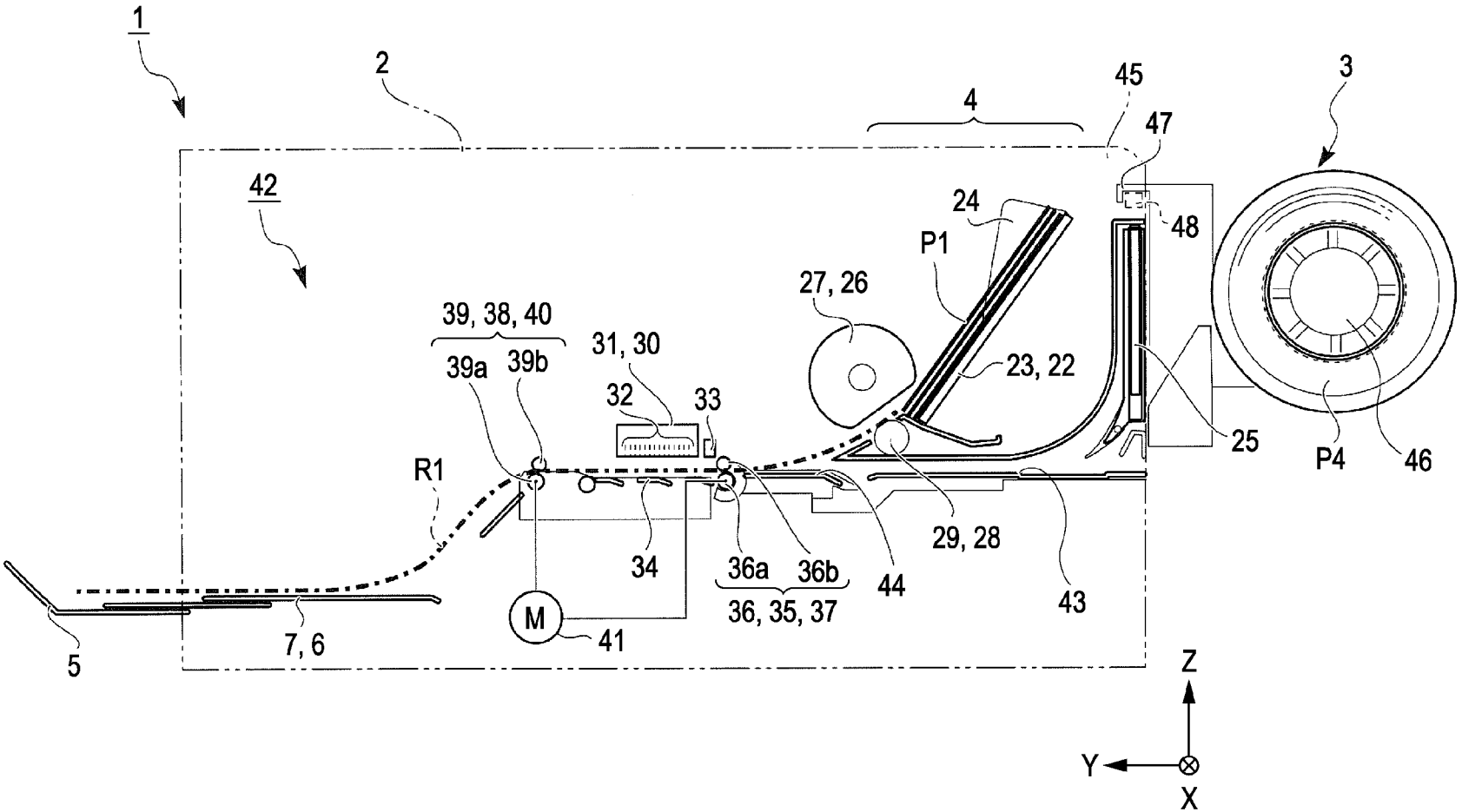
FIG. 4 is a schematic side view showing the inside of the printer according to the invention (at the time of transporting a first type of medium).

Shown in FIG. 4 is a schematic side view showing the inside of the printer 1 when transporting the plain paper (the first type of medium P1) and then performing recording thereon.

As shown in FIG. 4, the printer 1 includes the medium feed device 42 which sends the medium, and a recording section 30. Also, the medium feed device 42 includes the first placement section 22, the first feed section 26, a separator 28, the second feed section 35, the recording section 30, a third feed section 38, and the first discharge section 6. Of these, the first placement section 22 is provided such that the plain paper P1 can be placed thereon. Specifically, the first placement section 22 includes the hopper 23 and a first edge guide 24.

Then, the hopper 23 is provided so as to be able to move toward or away from the feed roller 27, which will be described later, integrally with the plain paper P1 placed thereon. Also, the first edge guide 24 is provided in a pair so as to be able to move toward or away from the feed roller 27 integrally with the hopper 23 and move on the hopper in the width direction X at both sides in the width direction of the plain paper P1.

Therefore, it is possible to neatly align both side ends of the plain paper P1 placed on the hopper. Also, it is possible to precisely determine the position of the plain paper P1 in the width direction X on the hopper.

Also, the first feed section 26 is provided so as to be able to send the plain paper P1 on the holder to the downstream side in a feed direction. Specifically, the first feed section 26 has the feed roller 27 which is driven by a first motor (not shown).

Then, the first feed section 26 is provided so as to be able to send the topmost plain paper P1 to the downstream side in the feed direction by a frictional force when the feed roller 27 over the hopper comes into contact with the topmost plain paper P1.

Also, in this embodiment, a configuration is made such that the hopper 23 that is the first placement section 22 moves toward or away from the feed roller 27. However, it is not limited thereto. It is acceptable if it is a configuration in which the hopper 23 and the feed roller 27 relatively move toward or away from each other. In other words, it is a matter of course that a configuration is also acceptable in which the feed roller 27 moves toward or away from the hopper 23.

Furthermore, the separator 28 is provided so as to be able to separate extra second and subsequent plain papers P1 from the topmost plain paper P1 in a case where a plurality of sheets of plain paper P1 to be sent by the first feed section 26 is overlapped. Specifically, the separator 28 has a so-called retard roller 29 that is a roller which is a known technology as one example and rotates in accordance with a given load.

Also, it is a matter of course that the separator 28 may be a pad formed of a material having high coefficient of friction.

Then, a configuration is made such that the leading end of the topmost plain paper P1 is guided to the second feed section 35 by a second guide section 44 provided further at the downstream side (the arrow direction of a Y-axis) in the feed direction at the time of recording than a first guide section 43.

Here, in the case of the exclusive paper P3, the paperboard, the CD-R tray, or the like P2, or the rolled paper P4, as will be described later, the first guide section 43 is configured so as to guide the medium.

Also, the second feed section 35 is configured so as to be able to send the plain paper P1, which has been sent by the first feed section 26, to the recording section 30 on the further downstream side in the feed direction in the case of the plain paper P1.

Also, although the details will be described later, in the case of the media such as the exclusive paper P3 and the paperboard, the CD-R tray, or the like P2, a configuration is made such that it is possible to send these media to the upstream side and the downstream side in the feed direction at the time of recording.

Specifically, the second feed section 35 includes a first roller pair 36. The first roller pair 36 is constituted by a first driving roller 36*a* which is driven by the power of a second motor 41 that is, for example, a DC motor, and a first driven roller 36*b* which is driven and rotated.

Here, the "DC motor" means a so-called "brush-incorporated DC motor" or "brushless motor" which uses a direct-current power supply, and a "stepping motor" which is driven in proportion to the number of input pulses is not included.

Further, although the details will be described later, the second feed section 35 is configured such that the first driving roller 36*a* and the first driven roller 36*b* can be relatively moved toward or away from each other by a first approaching and separating movement section 37. That is, a configuration is made such that an approached state and a separated state can be changed over. In this embodiment, the first driven roller 36*b* is provided so as to be able to move toward or away from the first driving roller 36*a*.

Also, it is a matter of course that a configuration is also acceptable in which the first driving roller 36*a* moves toward or away from the first driven roller 36*b*. In this embodiment, the reason for adopting a configuration in which the first driven roller 36*b* moves toward or away from the first driving roller 36*a* is because, considering a power transmission mechanism to the first driving roller 36*a*, a configuration in which a driven and rotated side is movable is easily made, compared to a configuration in which a driving side is movable.

Also, as the first approaching and separating movement section 37 that is a section for performing approaching or separating movement, a mechanism which transmits power by using a cam mechanism or a gear mechanism can be given.

Also, a configuration is made such that a so-called skew removal operation is carried out which is an operation for correcting the position of the plain paper P1 with respect to the feed direction when the plain paper P1 is sent from the first feed section 26 to the second feed section 35.

The skew removal operation may be a so-called "biting and discharging system" or may be a "thrusting system".

Here, the "biting and discharging system" means a system in which the first roller pair 36 that is the second feed section 35 first pinches the leading end of the plain paper P1 and is then reversely driven, thereby reversely sending the leading end side of the plain paper P1 to the upstream side in the feed direction, and then, the position of the leading end of the plain paper is made to follow the nip line by bending the plain paper P1 and then pressing the leading end of the plain paper P1 against a nip line of the first roller pair 36 between the feed roller 27 that is the first feed section 26 and the first roller pair 36 that is the second feed section 35.

That is, it means a system in which after the leading end of the plain paper P1 is first bitten by the first roller pair 36, the leading end side of the plain paper P1 is discharged to the upstream side in the feed direction, whereby the plain paper P1 is bent, thereby making the position of the leading end follow the nip line.

Here, the "nip line" means a line which is formed by the circumscribed locations of the first roller pair 36. That is, the nip line is a line which is formed by the pinching locations of the first roller pair 36.

On the other hand, the "thrusting system" is a system in which the position of the leading end of the plain paper P1 is made to follow the nip line by sending the plain paper P1 to the downstream side in the feed direction by the feed roller 27, thereby pressing the leading end of the plain paper P1 against the nip line of the first roller pair 36 in a stopped state or a reversely driven state. It means a system in which the position of the leading end is made to follow the nip line by thrusting the leading end of the plain paper P1 against the first roller pair 36. Also, the position of the leading end may be made to follow the nip line by bending the plain paper P1 between the feed roller 27 and the first roller pair 36, or the position of the leading end may be made to follow the nip line without bending.

Therefore, in the case of the plain paper P1, even when the position of the plain paper P1 with respect to the feed direction is tilted, it is possible to send the plain paper P1 to the recording section 30 after correction of the position of the plain paper P1.

Also, the recording section 30 is configured so as to be able to carry out recording on the medium (any of P1 to P4) such as the plain paper which has been sent thereto. Specifically, the recording section 30 includes a recording head 31 and a medium support section 34.

Of these, the recording head 31 is provided so as to be able to carry out recording by discharging ink droplets from nozzle rows 32. Also, the medium support section 34 is provided at a position facing the recording head 31. Then, the medium support section is provided so as to be able to keep a predetermined distance between the recording head 31 and the medium (any of P1 to P4) such as the plain paper by supporting the medium (any of P1 to P4) such as the plain paper from below in a vertical direction.

Also, in the recording section 30, a configuration is made such that the distance in a Z-axis direction between the recording head 31 and the medium support section 34 can be adjusted in accordance with the kind, such as the material or the thickness, of the medium (any of P1 to P4) which is sent. In other words, a configuration is made such that the recording head 31 and the medium support section 34 can be relatively displaced. The displacement may be manually performed or may be automatically performed.

Here, the Z-axis direction is a direction in which the recording head 31 and the medium (any of P1 to P4) face each other.

A configuration is also acceptable in which the recording head 31 is displaced with respect to the medium support section 34, or a configuration is also acceptable in which conversely, the medium support section 34 is displaced with respect to the recording head 31. This is for preventing contact between the recording head 31 and the medium (any of P1 to P4) which is sent. As a result, it is possible to prevent breakage or contamination of the recording head 31 and breakage or contamination of the medium (any of P1 to P4).

Further, the third feed section 38 is provided further at the downstream side in the feed direction at the time of recording than the recording section 30 and provided so as to be able to further send the recorded medium (any of P1 to P4) to the downstream side in the feed direction. Specifically, the third feed section 38 has a second roller pair 39, similarly to the above-described second feed section 35. The second roller pair 39 is constituted by a second driving roller 39*a* which is driven by the power of the second motor 41, and a second driven roller 39*b* which is driven and rotated.

Further, although the details will be described later, the third feed section 38 is configured such that the second driving roller 39*a* and the second driven roller 39*b* can be relatively moved toward or away from each other by a second approaching and separating movement section 40. That is, a configuration is made such that an approached state and a separated state can be changed over. In this embodiment, the second driven roller 39*b* is provided so as to be able to move toward or away from the second driving roller 39*a*.

Also, the first discharge section 6 (refer to FIGS. 4 and 7) is provided so as to be able to receive and stack the plain papers P1 when the plain papers P1 recorded in the recording section 30 are sent and discharged to the downstream side in the feed direction by the third feed section 38. Specifically, the first discharge section 6 (refer to FIGS. 4 and 7) has the first tray 7 (refer to FIGS. 4 and 7) provided below in the vertical direction further on the downstream side in the feed direction at the time of recording than the third feed section 38. Therefore, the continuously discharged plain papers P1 can be stacked.

Figure 7:
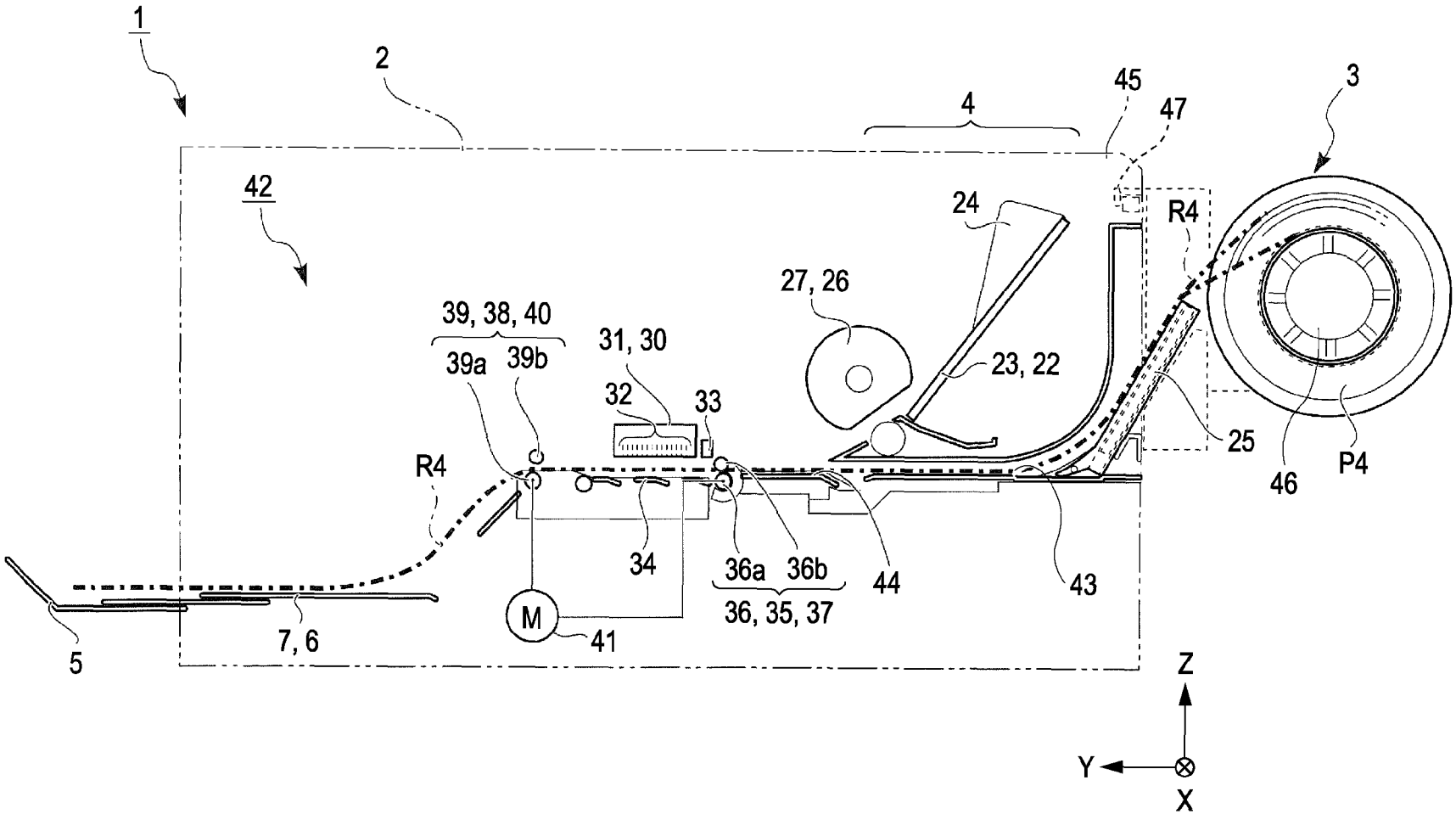
FIG. 7 is a schematic side view showing the inside of the printer according to the invention (at the time of transporting a fourth type of medium).

As described above, in a case where the medium is the plain paper P1, a configuration is made such that the medium is guided on the first feed pathway R1 that is a pathway from the first placement section 22 to the first discharge section 6 (refer to FIGS. 4 and 7).

Also, in FIG. 4, for easy understanding, illustration of the second discharge section 9 (refer to FIGS. 5 and 6) is omitted. The second tray 10 (refer to FIGS. 5 and 6) that is the second discharge section 9 is located at a position which does not interfere with discharge of the plain paper P1 onto the first tray.

The Case of the Paperboard, the CD-R Tray, or the Like: The Second Type of Medium P2

Next, an explanation will be given regarding a case where the medium is the paperboard, the CD-R tray, or the like (the second type of medium P2).

Shown in FIG. 5 is a schematic side view showing the inside of the printer when transporting the paperboard, the CD-R tray, or the like and performing recording thereon.

As shown in FIG. 5, in a state where the movable guide member 25 is closed, a configuration is made such that one straight line in a side view is formed by the upper surface of the second tray 10, the upper surface of the medium support section 34, the upper surface of the second guide section 44, and the upper surface of the first guide section 43.

Then, a second feed pathway R2 that is a feed pathway, on which the paperboard, the CD-R tray, or the like P2 is sent, is constituted by the upper surface of the second tray 10, the upper surface of the medium support section 34, the upper surface of the second guide section 44, and the upper surface of the first guide section 43. That is, the second feed pathway R2 is constituted on one straight line in a side view. The reason is because in a case where the medium is the paperboard, the CD-R tray, or the like P2, since the medium is a rigid body or has a strong elastic force, the medium cannot be sent on the first feed pathway (R1), and therefore, it is necessary to provide the second feed pathway R2 constituted on one straight line in aside view, separately from the first feed pathway R1.

Also, it goes without saying that also in the case of the third type of medium (P3) which will be described later, the medium can be sent on the second feed pathway (R2), similarly to the second type of medium (P2).

Specifically, in a case where the medium is the paperboard, the CD-R tray, or the like P2, a user places the paperboard, the CD-R tray, or the like P2 on the second tray 10 that is the second placement section 8 of the front of the printer 1. At this time, by setting the kind of the medium in the operation section (not shown), the first roller pair 36 is made to be in the separated state by the first approaching and separating movement section 37. Similarly, the second roller pair 39 is made to be in the separated state by the second approaching and separating movement section 40. Then, a user fits the medium to a given position on the second tray in accordance with the kind of the medium.

Here, the "given position" means a position in which a portion of the medium (P2 or P3) is located between the first driving roller 36*a* and the first driven roller 36*b* of the first roller pair 36.

Thereafter, a signal for the start of execution of recording is sent to the control section by manipulation of the operation section (not shown) by a user. As a result, the first roller pair 36 is changed over to the approached state. Therefore, a state is created where the medium (P2 or P3) is pinched by the first roller pair 36.

Here, a first sensor 33 which can detect presence or absence of the medium (P2 or P3) is provided between the first roller pair 36 and the recording head 31. Therefore, the printer 1 can determine that the medium (P2 or P3) has been set. On the basis of the decision, the control section changes over the first roller pair 36 to the approached state. In a case where it is determined that the medium (P2 or P3) is not set, an error display may be provided.

Also, the second roller pair 39 remains in the separated state. This is because a configuration is made such that precision is obtained when sending the medium (P2 or P3) by the first roller pair 36. Of course, the second roller pair 39 may be changed over to the approached state similarly to the first roller pair 36. In such a case, it is acceptable if the above-mentioned "given position" is a position in which a portion of the medium (P2 or P3) is located between the second driving roller 39*a* and the second driven roller 39*b* of the second roller pair 39.

Then, the medium (P2 or P3) pinched by the first roller pair 36 is sent to the upstream side in the feed direction at the time of recording until the medium (P2 or P3) is not detected by the first sensor 33. At this time, the medium (P2 or P3) moves to the upstream side in the feed direction at the time of recording on the second feed pathway (R2) while being guided by the second tray 10, the medium support section 34, the second guide section 44, and the first guide section 43.

Here, in a case where the length of the medium (P2 or P3) is long, the upstream side in the feed direction at the time of recording in the medium (P2 or P3) is configured so as to be able to protrude to the outside of the housing 2 while being guided by the first guide section 43. That is, a configuration is made such that it can protrude to the rear of the printer 1.

Then, the printer 1 can grasp the position of the downstream end in the feed direction at the time of recording in the medium (P2 or P3) by a timing in which the medium (P2 or P3) is not detected by the first sensor 33. That is, the printer can grasp the position of the leading end of the medium (P2 or P3) at the time of recording. By driving the first roller pair 36 on this basis, it is possible to fit the position of the leading end of the medium (P2 or P3) at the time of recording to a reference position at the time of the start of recording. This is commonly known as head poking.

Also, at this time, the medium (P2 or P3) remains in a state where it is pinched by the first roller pair 36.

Thereafter, a configuration is made such that the medium (P2 or P3) is sent to the downstream side in the feed direction at the time of recording by the first roller pair 36 and then recorded by the recording section 30. If the recording is completed, the medium (P2 or P3) is further sent to the downstream side in the feed direction at the time of recording by the first roller pair 36, thereby being discharged to the second tray 10. That is, the medium is discharged to a position approximately equal to a position where the medium (P2 or P3) had been set by a user.

Also, a configuration may be made such that by setting the kind of the medium (P2 or P3) in the operation section (not shown), the second tray 10 moves to a position of the same height in the vertical direction Z further on the downstream side in the feed direction at the time of recording than the third feed section 38. A configuration is also acceptable in which the movement of the second tray 10 is performed by the power of a motor (not shown) or a configuration is also acceptable in which the position is manually changed over.

Also, if it is a case where discharge in the case of the plain paper P1 is not obstructed, and the upper surface of the second tray 10 is at the same height in the vertical direction Z as the upper surface of the medium support section 34, the same position as that in the case of the plain paper P1 is also acceptable. In such a case, a configuration is also acceptable in which the position of the second tray 10 moves up to a position shown in FIG. 4 in conjunction with an operation which opens forward the second cover member 5 (refer to FIGS. 4 and 7).

Also, the control section is configured so as to determine whether or not the movable guide member 25 is in a closed state shown in FIG. 4 by using a second sensor (not shown). This is for determining whether or not the second feed pathway R2 that is a feed pathway, on which the paperboard, the CD-R tray, or the like P2 is sent, is in an opened state in the back of the printer 1.

Then, in the case of the opened state, a configuration is made such that a caution is given to a user, thereby urging him to switch to a closed state. For example, it is possible to perform the urging by displaying the purport in a display section such as a liquid crystal panel provided at the operation section (not shown) or emitting a warning sound.

The Case of the Exclusive Paper: The Third Type of Medium P3

Subsequently, an explanation will be made regarding a case where the medium is the exclusive paper (the third type of medium P3).

Shown in FIG. 6 is a schematic side view showing the inside of the printer when transporting the exclusive paper and then performing recording.

As shown in FIG. 6, in a state where the movable guide member 25 is opened, a first straight line section S1 is constituted by the upper surface of the second tray 10, the upper surface of the medium support section 34, the upper surface of the second guide section 44, and the upper surface of the first guide section 43. Further, the curved section S2 in a side view is constituted by the upstream side in the feed direction at the time of recording in the upper surface of the first guide section 43 and the rocking center side of the movable guide member 25. Furthermore, a second straight line section S3 is constituted by the free-end side of the movable guide member 25.

Then, the third feed pathway R3 that is a feed pathway, on which the exclusive paper P3 is sent, is constituted by the first straight line section S1, the side-viewed curved section S2, and the second straight line section S3. That is, the third feed pathway R3 is constituted so as to have the side-viewed curved section S2 in the back of the printer 1. This is for bending the position of the exclusive paper P3 on the upstream side in the feed direction at the time of recording when the exclusive paper P3 that is a medium having flexibility is placed on the second placement section 8 similarly to the paperboard, the CD-R tray, or the like P2 and then sent to the upstream side in the feed direction at the time of recording in a step before execution of recording.

As a result, a distance, by which the medium (P3) protrudes to the rear of the printer 1, can be shortened compared to the case of using the second feed pathway R2. Therefore, even in a case where an obstacle such as a wall of a room is present in the vicinity of the back of the printer 1, a possibility that the medium (P3) which has protruded to the rear of the printer 1 in the step before the execution of recording may come into contact with the obstacle can be almost eliminated. As a result, in the case of the exclusive paper P3, by using the third feed pathway R3, rather than the second feed pathway R2, it is not necessary to secure a sufficiently wide space which was required at the time of use of the second feed pathway R2 in the back of the printer 1.

That is, in the case of the exclusive paper P3, it is possible to eliminate the need for the user to move forward the printer 1 in order to secure a sufficiently wide space at the rear of the printer 1.

Also, the exclusive paper P3 has a strong elastic force compared to the plain paper P1 and the frictional resistance or the like, which is generated between the exclusive paper and the feed pathway, is large. For this reason, in the feed roller 27, it is difficult to provide a sufficient feed force to the exclusive paper P3 and it is not possible to send the exclusive paper in the same way as the plain paper P1 on the first feed pathway R1.

For this reason, a configuration is made such that the exclusive paper P3 is placed on the second placement section 8 similarly to the paperboard, the CD-R tray, or the like P2 and then pinched by the first roller pair 36, thereby being sent to the upstream side and the downstream side in the feed direction at the time of recording.

Here, the first roller pair 36 has a configuration of firmly pinching the medium (P3), thereby allowing a large feed force to be provided to the medium (P3), compared to the feed roller 27.

Then, the exclusive paper P3 cannot be sent in the same way as the plain paper P1 on the first feed pathway R1. However, the exclusive paper P3 is set to be a medium having flexibility and a weak elastic force, compared to the paperboard, the CD-R tray, or the like P2.

Thereafter, similarly to the case of the paperboard, the CD-R tray, or the like P2 described above, the exclusive paper P3 pinched by the first roller pair 36 is sent to the upstream side in the feed direction at the time of recording until the exclusive paper P3 is not detected by the first sensor 33. At this time, the exclusive paper P3 moves to the upstream side in the feed direction at the time of recording on the third feed pathway (R3) while being guided by the second tray 10, the medium support section 34, the second guide section 44, the first guide section 43, and the movable guide member 25.

Then, the printer 1 can grasp the position of the downstream end in the feed direction at the time of recording in the exclusive paper P3 from a timing in which the exclusive paper P3 is not detected by the first sensor 33. That is, the printer can grasp the position of the leading end of the exclusive paper P3 at the time of recording. By driving the first roller pair 36 on this basis, it is possible to fit the position of the leading end of the exclusive paper P3 at the time of recording to a reference position at the time of the start of recording. This is commonly known as head poking.

Also, at this time, the exclusive paper P3 remains in a state where it is pinched by the first roller pair 36.

Thereafter, a configuration is made such that the exclusive paper P3 is sent to the downstream side in the feed direction at the time of recording by the first roller pair 36 and then recorded by the recording section 30. Then, if the recording is completed, the exclusive paper P3 is further sent to the downstream side in the feed direction at the time of recording by the first roller pair 36, thereby being discharged to the second tray 10. That is, the exclusive paper is discharged to a position approximately equal to a position where the exclusive paper P3 had been set by a user.

Also, in this embodiment, a configuration is adopted in which the exclusive paper P3 is set on the second placement section. However, it is not limited thereto. A configuration is also acceptable in which the exclusive paper P3 is set on the movable guide member. In such a case, it is not necessary to reversely send the exclusive paper P3 once to the upstream side in the feed direction at the time of recording. In this embodiment, the reason for adopting a configuration in which the exclusive paper P3 is set on the second placement section is because it is possible to easily pinch the exclusive paper P3 by the first roller pair 36 that is the second feed section 35, when the exclusive paper has been set.

Further, by reversely sending the exclusive paper once, it is possible to measure a load of a motor when sending the exclusive paper by the first roller pair 36 in the step before execution of recording. Then, it is possible to determine a section, in which the exclusive paper P3 is located, in accordance with the level and the manner of changing the measured load. Further, it is because it is possible to add a correction value to an input to the motor when sending the exclusive paper to the downstream side in the feed direction at the time of recording, on the basis of the decision, and then drive the motor.

Specifically, it is because it is possible to detect an electric current value of the motor and set the correction value in accordance with the electric current value. It is because it is possible to reduce error in the feed amount as much as possible by changing and setting the magnitude of the correction value in accordance with the magnitude of the electric current value of the motor. That is, it is because it is possible to stabilize the feed precision.

Also, it is because in a case where the magnitude of the electric current value of the motor fluctuates during the sending of the exclusive paper P3, it is possible to perform setting such that the magnitude of the correction value also fluctuates in accordance with a fluctuation of the magnitude of the electric current value. That is, it is possible to stabilize the feed precision even during the sending of the exclusive paper P3.

Also, in this embodiment, also in the case of sending the exclusive paper P3, it is not necessary to detach the roll holder 3. That is, a configuration is made such that there is no danger that, when placing the movable guide member 25 in an opened and extended state, the rolled paper will interfere with the creation of the state. In a state where the movable guide member 25 has been opened and extended, the back face side of the movable guide member 25 may come into contact with the outer circumference of the rolled paper P4 or a configuration may be made such that the back face side does not come into contact with the outer circumference. It is because, regardless of the case, the exclusive paper P3 can be guided.

The Case of the Rolled Paper: The Fourth Type of Medium P4

Subsequently, an explanation will be made regarding a case where the medium is the rolled paper (the fourth type of medium (P4)).

Shown in FIG. 7 is a schematic side view showing the inside of the printer when transporting the rolled paper and then performing recording.

As shown in FIG. 7, in a state where the movable guide member 25 is opened and contracted, a configuration is made such that the rolled paper P4 can be sent to the recording section 30 further from the back face side than the movable guide member 25 on a fourth feed pathway (R4) that is a pathway, on which the rolled paper P4 is sent. Specifically, in a state where the movable guide member 25 is opened and contracted, the fourth feed pathway R4 is formed from the roll holder 3 to the first tray 7 through the movable guide member 25, the first guide section 43, the second guide section 44, and the medium support section 34. Here, the movable guide member 25 is provided so as to be able to be contracted and extended, as described above. Therefore, the set rolled paper P4 can be fed without detachment of the movable guide member 25 by a user.

Figure 10B:
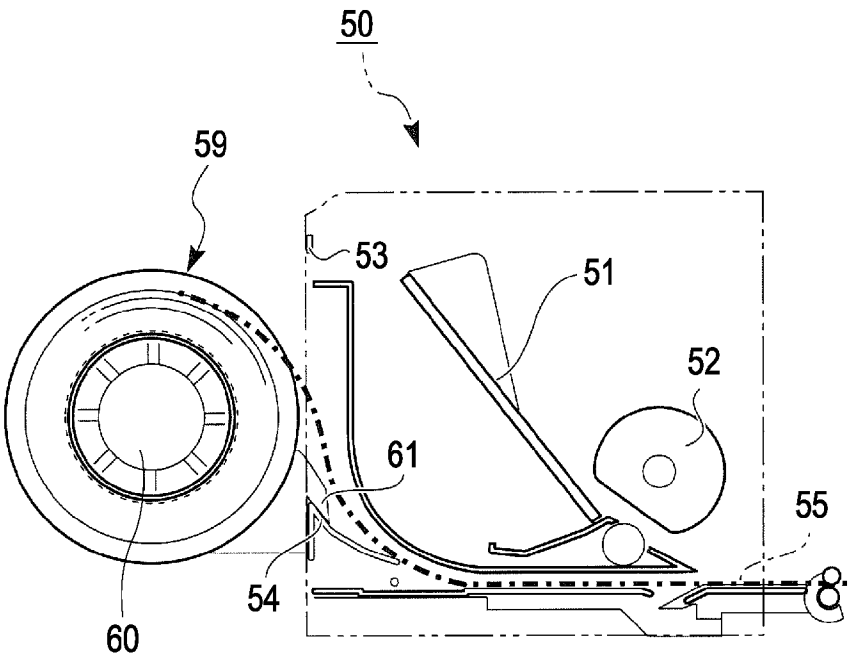
FIGS. 10A and 10B are side views showing an outline of a medium feed device which is considered by the invention.
Figure 10A:
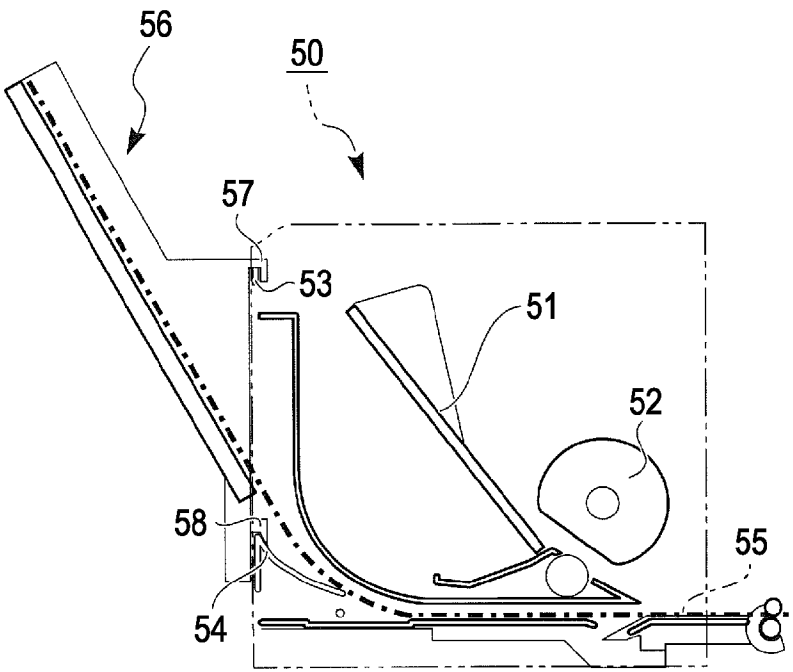

That is, it is not necessary to detach a medium support member and then attach a rolled paper holder when feeding a rolled paper, as in the configuration of the medium feed device shown in FIGS. 10A and 10B described previously. Further, in other words, it is not necessary to replace the medium support member with the rolled paper holder.

Also, a configuration is made such that the free-end side of the movable guide member 25 comes into pressure-contact with a face of the unwound rolled paper P4, which becomes an inner face in a step in which the rolled paper P4 has been wound. The face becomes a back side when a face which is recorded at the time of recording is set to be a surface. Therefore, there is no danger that scratches, contamination, or the like will be generated in the surface of the rolled paper P4.

Furthermore, a configuration is made such that the free-end side of the movable guide member 25 can come into pressure-contact with the unwound rolled paper P4 regardless of the magnitude of the diameter of the rolled paper P4. That is, a configuration is made such that the pressure-contact can be made regardless of whether the remaining amount of the rolled paper P4 is large or small.

Specifically, preparation for the start of recording is completed by creating a state where a new rolled paper P4 is set in the roll holder 3 and the downstream side of the rolled paper P4 is pinched by a transport roller pair of the feed pathway R4. In this state, the free-end side of the movable guide member 25 comes into pressure-contact with the unwound rolled paper P4.

Then, the remaining amount of the rolled paper P4 gradually decreases with the feeding of the rolled paper P4. For this reason, the diameter of the rolled paper P4 is gradually reduced. Accordingly, an unwound position of the rolled paper P4, that is, a position where the unwound rolled paper P4 is separated from the outer circumference of the rolled paper P4 in a wound state gradually moves toward the center of the diameter of the rolled paper P4. A configuration is made such that even in such a case, the free-end side of the movable guide member 25 can come into pressure-contact with the unwound rolled paper P4.

Therefore, it is possible to always maintain a constant position of the unwound rolled paper P4 further on the downstream side in the feed direction than a location where the movable guide member 25 and the rolled paper P4 come into contact with each other. As a result, the position of the unwound rolled paper P4 in the feed pathway can be stabilized, whereby recording precision can also be stabilized.

Also, in this embodiment, a configuration is made such that the rolled paper P4 is disposed in the vicinity of the back face side of the movable guide member 25 by the roll holder 3. However, it is not limited thereto. The rolled paper P4 may be provided at a position apart from the back face side of the printer main body. In other words, the roll holder 3 as a roll holding section may be constituted by a separate body separating from the printer main body. This is because even in such a case, the same working effects can be obtained.

Also, in this embodiment, comparing the third feed pathway R3 with the fourth feed pathway R4, they are common in a range in the feed direction Y, in which the movable guide member 25, the first guide section 43, the second guide section 44, and the medium support section 34 are provided. However, it is not limited thereto. It is acceptable if it is a configuration in which they are common in a range in which at least the movable guide member 25 is provided. Also, a configuration is also acceptable in which the fourth feed pathway R4 passes on the second discharge section (the second tray), not on the first discharge section (the first tray).

Subsequently, an opening and closing mechanism of the movable guide member 25 will be described in more detail.

Figure 8B:
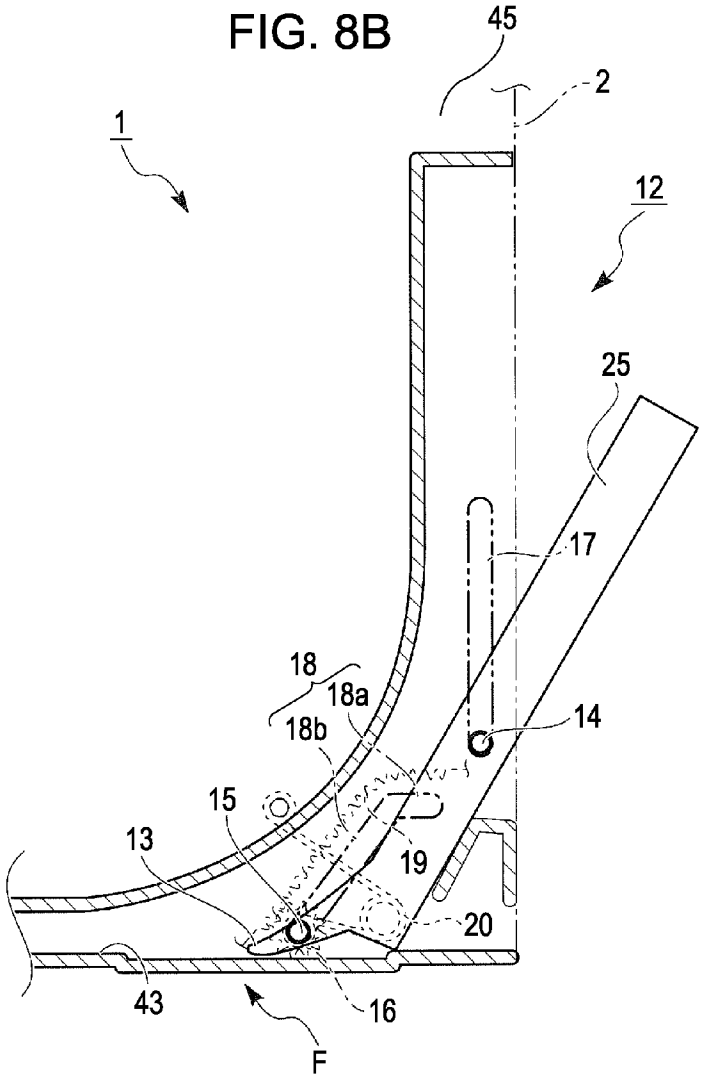
FIGS. 8A and 8B are schematic side views showing a configuration in which the movable guide member moves.
Figure 8A:
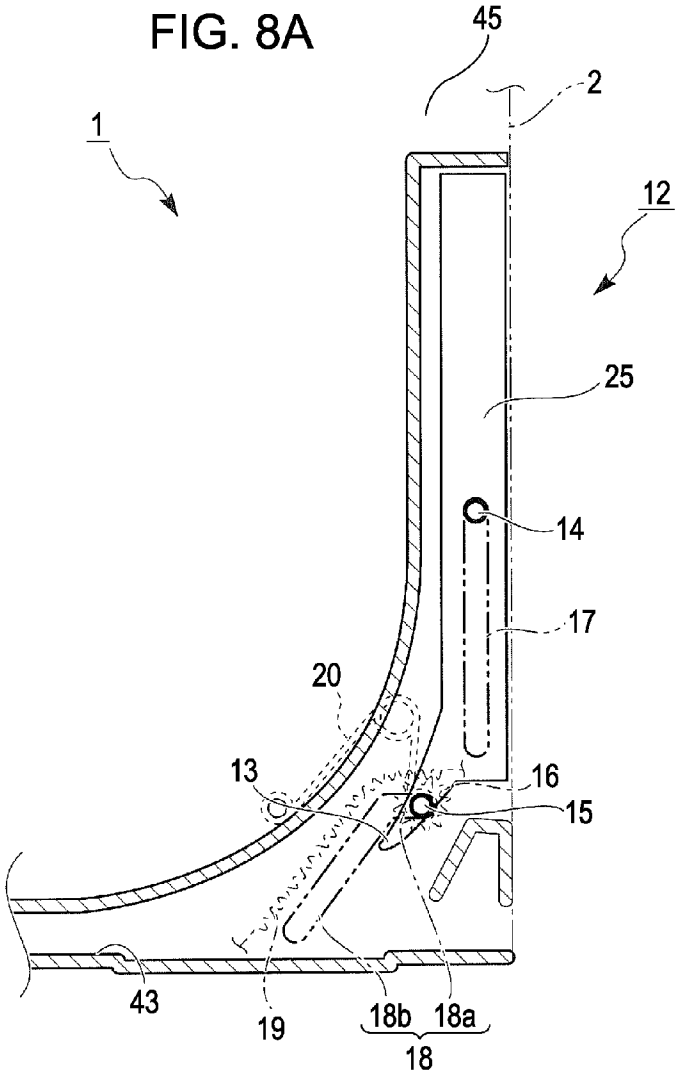

Shown in FIGS. 8A and 8B are schematic side views showing the opening and closing mechanism of the movable guide member. Of these, FIG. 8A shows a state where the movable guide member is closed. On the other hand, FIG. 8B shows a state where the movable guide member is opened.

Also, in FIGS. 8A and 8B, illustration of the roll holder is omitted to facilitate understanding of the opening and closing mechanism of the movable guide member.

As shown in FIGS. 8A and 8B, an opening and closing mechanism 12 of the movable guide member 25 includes a first groove portion 17, a second groove portion 18, a first projection portion 14, a second projection portion 15, and a spring 20 that is one example of a biasing section. Of these, the first groove portion 17 is provided in one pair at the base body portion 45 of the printer 1 on both sides in the width direction of the movable guide member 25. Specifically, the first groove portion is provided to extend in the Z-axis direction. Also, the second groove portion 18 is provided in one pair at the base body portion 45 of the printer 1 on both sides in the width direction of the movable guide member 25, similarly to the first groove portion 17.

Further, the second groove portion 18 has a first portion 18*a* and a second portion 18*b*. Specifically, as shown in FIGS. 8A and 8B, the first portion 18*a* on the upper side in the Z-axis direction is provided so as to be approximately perpendicular to a direction (the Z-axis direction) in which the first groove portion 17 extends and is provided. Also, the second portion 18*b* further on the lower side in the Z-axis direction than the first portion 18*a* is provided so as to extend in a direction intersecting the Z-axis direction. That is, the second groove portion 18 is configured in a curved shape in a side view.

Further, the first projection portion 14 is provided in one pair at both sides in the width direction of the movable guide member 25 and constituted so as to be engaged with the first grove portion 17. That is, the first projection portion 14 and the first groove portion 17 are provided so as to constitute a grooved cam.

Also, the second projection portion 15 is provided in one pair at both sides in the width direction of the movable guide member 25 similarly to the first projection portion 14 and constituted so as to be engaged with the second grove portion 18. That is, the second projection portion 15 and the second groove portion 18 are provided so as to constitute a grooved cam.

Further, the spring 20 is provided so as to bias the movable guide member 25 to a position in a state where the movable guide member 25 is opened and a position in a state where the movable guide member 25 is closed. A so-called two-position stabilization mechanism is provided which stabilizes the movable guide member 25 at two positions. Specifically, one end side of the spring 20 is engaged with the base body portion 45 and the other end side is engaged with the second projection portion 15 of the movable guide member 25. Then, a configuration is made such that the spring 20 always biases the second projection portion 15 toward both side end portions in a moving direction in the second groove portion. Therefore, there is no danger that the movable guide member 25 will be made to be in a halfway state between an opened state and a closed state.

Also, in the vicinity of the second groove portion 18, a rack portion 19 is formed along a direction in which the second groove portion 18 extends and is provided. Further, at the second projection portion 15, a pinion portion 16 which is meshed with the rack portion 19 is rotatably provided. A configuration is made such that the rack portion 19 and the pinion portion 16 constitute a rack-and-pinion mechanism, whereby changing-over of the opened state and the closed state of the movable guide member 25 can be smoothly performed. In other words, the pinion portion 16 can play the role of a roller which reduces frictional resistance which is generated between the second projection portion 15 and the second groove portion 18.

Also, in this example, adaptation of the rack-and-pinion mechanism is for preventing grease from being pushed to ends. Therefore, smoothness at the time of the changing-over can be maintained.

When performing changing-over from the closed state shown in FIG. 8A to the opened state shown in FIG. 8B, a user moves the upper side of the movable guide member 25 in FIG. 8A to the rear (the right side in FIG. 8A) of the printer 1. At this time, the second projection portion 15 moves in the first portion 18*a* of the second groove portion 18 and the movable guide member 25 is rocked around the first projection portion 14 which is engaged with the first groove portion 17.

Also, a cutout portion for easily catching a user's finger is formed in the upper side of the movable guide member 25.

Thereafter, if a user tries to rock the upper side of the movable guide member 25 to a direction (the right side in FIG. 8A) which further opens it, since the first projection portion 14 tries to move along the first groove portion 17, a force component is generated in which the movable guide member 25 tries to move downward. As a result, the first projection portion 14 is guided by the first groove portion 17, thereby moving downward, and the second projection portion 15 is guided by the second portion 18*b* of the second groove portion 18, thereby moving downward.

That is, the movable guide member 25 moves so as to rock around the left side in FIG. 8A further than the first projection portion 14 and the second projection portion 15. Accordingly, compared to a configuration in which rocking is performed around only one of the first projection portion 14 and the second projection portion 15, it is possible to shorten a rocking distance of the upper side of the movable guide member 25, which is required for constituting the above-described third feed pathway R3 by connecting the first guide section 43 and the movable guide member 25. That is, a rocking distance to the rear of the printer 1 can be shortened.

Therefore, compared to the size of a space required for an opening and closing operation of the movable guide member 25 to the rear of the printer 1 in a configuration in which rocking is performed around only one of the first projection portion 14 and the second projection portion 15, it is possible to make the size of a space required for the opening and closing operation small. That is, the movable guide member 25 can be opened and closed even in a narrow space.

Also, the movement of the movable guide member 25 at this time need not necessarily be rocking around one point. This is because even in a configuration in which the position of the center changes during movement, the same working effects can be obtained.

Then, the movement of the movable guide member 25 is stopped by at least one of the arrival of the first projection portion 14 at the lower end of the first groove portion 17 and the arrival of the second projection portion 15 at the lower end of the second groove portion 18, and a state shown in FIG. 8B is created where the movable guide member 25 is opened. At this time, a configuration is made such that the lower end of the movable guide member 25 and the first guide section 43 are engaged with each other (not shown). Specifically, a first rib 13 is formed at a base end of the movable guide member 25. The first rib 13 is constituted so as to be engaged in a comb-teeth fashion with a second rib (not shown) formed on the first guide section. This is for preventing the upstream end of the above-described third type of medium P3 from being caught on a joint (a connection place F) of the lower end of the movable guide member 25 and the first guide section 43 when the upstream end of the third type of medium P3 enters from the first straight line section S1 to the curved section 32 when sending the third type of medium P3 to the upstream side in the feed direction at the time of recording.

Also, an explanation will be made in regard to the time of performing changing-over from the opened state shown in FIG. 8B to the closed state shown in FIG. 8A. If a user tries to move the upper side of the movable guide member 25 in a closing direction (to the left side in FIG. 8B), since the first projection portion 14 tries to move along the first groove portion 17, a force component is generated in which the movable guide member 25 tries to move upward. As a result, the first projection portion 14 is guided by the first groove portion 17, thereby moving upward, and the second projection portion 15 is guided by the second portion 18*b* of the second groove portion 18, thereby moving upward.

Thereafter, a user moves the upper side of the movable guide member 25 in FIG. 8B to the front (the left side in FIG. 8B) of the printer 1. At this time, the second projection portion 15 moves in the first portion 18*a* of the second grove portion 18, whereby the movable guide member 25 rocks around the first projection portion 14 which is engaged with the first groove portion 17. Then, the movable guide member 25 is made to be in the closed state shown in FIG. 8A.

Also, of course, a configuration is also acceptable in which the movable guide member 25 is automatically opened and closed by transmitting the power of a motor (not shown) to the movable guide member 25 by the above-described rack-and-pinion mechanism (16 and 19).

Also, a configuration is made such that replacement of the rolled paper P4 is performed by detaching the roll holder 3 from the printer main body. Specifically, the engagement portion 47 of the roll holder 3 is separated from the engaged portion 48 of the printer main body. Then, the press-in portion 46 of the roll holder 3 is pulled out from the core of the rolled paper P4 and then pressed into the core of another rolled paper. Thereafter, the engagement portion 47 of the roll holder 3 is engaged with the engaged portion 48 of the printer main body.

Also, in the configuration of this embodiment, a configuration is adopted in which the first type of medium P1 to the fourth type of medium P4 are respectively sent by the first feed pathway R1 to the fourth feed pathway R4. However, it is not limited thereto. As the invention of this application, it is acceptable if it is a configuration in which the third type of medium P3 is sent by the third feed pathway R3 and the fourth type of medium P4 is sent by the fourth feed pathway R4. In other words, a printer is also acceptable which has a configuration in which the first feed pathway R1 and the second feed pathway R2 are not provided, whereby the printer does not respond to the first type of medium P1 and the second type of medium P2.

The medium feed device 42 of this embodiment is the medium feed device 42 including the third feed pathway R3 as a feed pathway, on which the third type of medium P3 that is one example of a fed medium is sent, the fourth feed pathway R4, on which the fourth type of medium P4 is sent, and the second feed section 35 as a feed section which sends the third type of medium P3 and the fourth type of medium P4, and having a configuration which can send the third type of medium P3 that is a fed medium of a single sheet shape and the fourth type of medium P4 that is a fed medium having a roll shape, and is characterized by a configuration in which the second feed section 35 is provided so as to send the medium (P3 or P4) in the front-and-back direction of the medium feed device 42, the medium feed device 42 is provided with the movable guide member 25 as a guide member which guides the third type of medium P3 and the fourth type of medium P4 in the back face side of the medium feed device 42, the movable guide member 25 is provided so as to be able to be extended and contracted in a direction connecting the base end side and the free-end side of the movable guide member 25, the movable guide member 25 forms the fourth feed pathway R4 that is a feed pathway for the fourth type of medium P4 which is sent further from the back side than the movable guide member 25, in a first state where the movable guide member 25 is contracted, and the movable guide member 25 forms the third feed pathway R3 as a feed pathway for the third type of medium P3 which is sent from the movable guide member, in a second state where the movable guide member 25 is extended.

Also, in this embodiment, a feature is a configuration in which the medium feed device further includes the roll holder 3 as a roll holding section which holds the fourth type of medium P4 having a roll shape and also, in the second state of the movable guide member 25, the roll holder 3 can hold the fourth type of medium P4 having a roll shape.

Further, in this embodiment, a feature is a configuration in which in the first state of the movable guide member 25, the free end of the movable guide member 25 comes into pressure-contact with a place in the fourth type of medium P4 unwound from the roll shape, regardless of the magnitude of the outer diameter of the fourth type of medium P4 having a roll shape held by the roll holder 3.

Also, in this embodiment, a feature is a configuration in which the movable guide member 25 can take, in the back face side of the medium feed device 42, a first position which follows the back face, and a second position which is a position fallen further to the rear than the back face, thereby being inclined with respect to the front-and-back direction, and becomes a state where the movable guide member can be extended and contracted.

Furthermore, in this embodiment, a feature is a configuration in which the movable guide member 25 being in the second state and having the second position guides the leading end side in an advancing direction of the third type of medium P3 sent from the front side in the front-and-back direction in the third feed pathway R3 to the back side by the second feed section 35, onto the movable guide member, and the third type of medium P3 guided onto the movable guide member is sent from the movable guide member to the front side in the front-and-back direction by the second feed section 35.

The printer 1 that is one example of the recording apparatus of this embodiment is characterized in that it includes the medium feed device 42 as a medium feed section which sends the third type of medium P3 and the fourth type of medium P4, each of which is one example of a recorded medium, in the feed direction Y, and the recording section 30 which performs recording on the third type of medium P3 and the fourth type of medium P4 sent by the medium feed device 42, by using the recording head 31.

Another Embodiment

Figure 9:
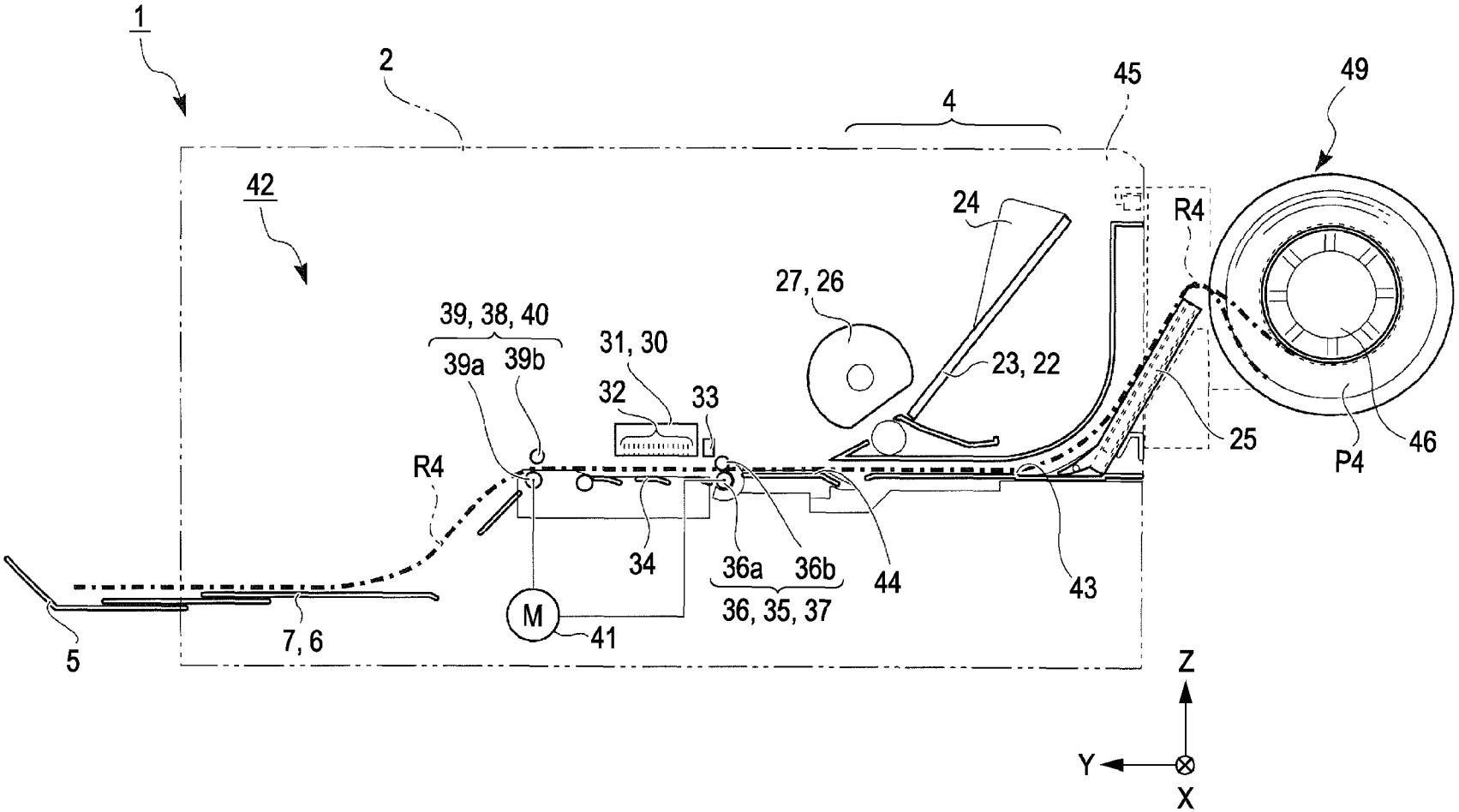
FIG. 9 is a schematic side view showing a printer of another embodiment (at the time of transporting the fourth type of medium).

Shown in FIG. 9 is a schematic side view showing the inside of the printer when transporting the rolled paper and then performing recording in another embodiment.

As shown in FIG. 9, a roll holder 49 of another embodiment is constituted so as to hold the rolled paper P4 such that a winding direction is reversed compared to the above-described embodiment.

Also, with regard to other members, they are the same as those of the above-described embodiment, so that the same symbols are used and the repeated explanation thereof is omitted.

A configuration is made such that the free-end side of the movable guide member 25 comes into pressure-contact with a face of the unwound rolled paper P4, which becomes an outer face in a step in which the rolled paper P4 has been wound. The face becomes a back side when a face which is recorded at the time of recording is set to be a surface. Therefore, there is no danger that scratches, contamination, or the like will be generated in the surface of the rolled paper P4.

Here, a significant difference from the above-described embodiment is that, by the pressure-contact of the free-end side of the movable guide member 25, the unwound rolled paper P4 can be bent so as to be in a state reverse to a state where the rolled paper P4 has been wound. That is, the unwound rolled paper P4 is bent back in a direction reverse to the wound state, whereby a so-called curling tendency that occurs in a wound state can be reduced.

Also, similarly to the above-described embodiment, a configuration is provided in which the free-end side of the movable guide member 25 comes into pressure-contact with the unwound rolled paper P4 regardless of a change in the remaining amount of the rolled paper P4. Therefore, the curling tendency can be reduced regardless of the remaining amount of the rolled paper P4. Also, it goes without saying that, similarly to the above-described embodiment, it is possible to stabilize the position of the unwound rolled paper P4 further in the downstream side than a pressure-contact location.

Another embodiment is characterized by a configuration in which the free end of the movable guide member 25 comes into pressure-contact with a face of the fourth type of medium P4 unwound from a roll shape, which was the outside in a step before being unwound.

Also, the invention is not limited to the above described examples, various modifications can be made within the scope of the invention stated in the claims, and it goes without saying that these modifications are also included in the scope of the invention.

What is claimed is:

1. A medium feed device which is capable of sending a medium of a single sheet shape and a medium which is held to have a roll shape, comprising:

a roll holding section which holds the medium which is held to have a roll shape; and a guide member in which a free-end side thereof can be extended and contracted and which forms a first feed pathway for the medium which is held to have a roll shape which is fed from the roll holding section, in a first contracted state, such that the roll shaped medium is fed from the free end of the guide member and contacts the guide member when being transported on the first feed pathway and forms a second feed pathway only for the medium of a single sheet shape in a second extended state such that the shingle sheet shaped medium contacts the guide member when being transported on the second feed pathway.

2. The medium feed device according to claim 1, wherein also in the second state of the guide member, the roll holding section can hold the medium which is held to have a roll shape.

3. The medium feed device according to claim 1, wherein in the first state of the guide member, the free end of the guide member comes into pressure-contact with a place of the medium unwound from a roll shape, regardless of the magnitude of an outer diameter of the medium which is held to have a roll shape held by the roll holding section.

4. The medium feed device according to claim 3, wherein the free end of the guide member comes into pressure-contact with a face of the medium unwound from the roll shape, which was the outside in a step before being unwound.

5. The medium feed device according to claim 1, wherein the guide member can take, in the back face side of the medium feed device, a first position which follows the back face, and a second position which is a position fallen further to the rear than the back face, thereby being inclined with respect to the front-and-back direction, and becomes a state where the guide member can be extended and contracted.

6. The medium feed device according to claim 5, wherein the guide member being in the second state and having the second position guides the leading end side in an advancing direction of the medium of a single sheet shape sent from the front side in the front-and-back direction to the back side by the feed section, onto the guide member, and the medium of a single sheet shape guided onto the guide member is sent from the guide member to the front side in the front-and-back direction by the feed section.

7. A recording apparatus comprising:

a medium feed section which sends a recorded medium in a feed direction; and a recording section which performs recording on the recorded medium sent by the medium feed section, by a recording head, wherein the medium feed section includes the medium feed device according to claim 1, and the recorded medium is the medium.

8. The medium feed device according to claim 1, wherein the medium which is held to have a roll shape contacts a non free-end side of the guide member prior to contacting any feed rollers of the first or second feed pathways.

* * * * *